US005564601A

United States Patent [19]

Cleland et al.

[11] Patent Number: 5,564,601

[45] Date of Patent: Oct. 15, 1996

[54] BEVERAGE DISPENSING MACHINE WITH IMPROVED LIQUID CHILLER

[76] Inventors: Robert K. Cleland, 11051 Via El Mercado, Los Alamitos, Calif. 90720; Larry Roberts, 10 Black Hawk Estates, Old Monroe; William C. Boettcher, P.O. Box 95, Foley, both of Mo. 93347

[21] Appl. No.: 349,561

[22] Filed: Dec. 5, 1994

[51] Int. Cl.[6] ..... B67D 5/56

[52] U.S. Cl. ..... 222/129.1; 222/146.6; 165/164

[58] Field of Search ..... 222/129.1, 146.6; 165/164, 918

[56] References Cited

U.S. PATENT DOCUMENTS 4,330,035 5/1982 Hillerstro ..... 165/164
5,190,188 3/1993 Credle, Jr. ..... 222/129.1 X
5,368,198 11/1994 Goulet ..... 222/129.1
5,460,222 10/1995 Blase ..... 165/164 X

*Primary Examiner*—Gregory L. Huson
*Attorney, Agent, or Firm*—Georges A. Maxwell

[57] ABSTRACT

A beverage dispensing machine including a cabinet having a utility section in which parts of a refrigeration machine and liquid-handling parts are housed and a thermally insulated section defining a compartment in which beverage concentrate supplies are removably positioned and that houses fluid-conducting parts of the machine including a liquid concentrate pump, water control valve, water and liquid concentrate metering and mixing devices and a pressurized heat exchange water tank through which an evaporator coil of the refrigeration machine extends and through which water to be dispensed is circulated and chilled; chilled water in the tank is circulated through a cooling coil in the compartment to chill the contents thereof.

15 Claims, 5 Drawing Sheets

T
32
31
7
6
55
58
59
54
R
53
56
7
22
6
24
W
23
WATER
C
P
51
52
50
56

31
T
55
56
57
24

32
55
T
22
56
57

66
70
31
62
61
67
64
69
68
T
69
32
66
60
67
68
63

BEVERAGE DISPENSING MACHINE WITH IMPROVED LIQUID CHILLER

BACKGROUND OF THE INVENTION

In the art of making and dispensing chilled beverages, beverages are commonly made by combining and mixing water and liquid beverage concentrate and dispensing the resulting beverages into serving glasses or the like, a serving at a time.

It is a practical necessity that the beverages be suitably chilled when dispensed. To this end, the water is commonly chilled prior to its being mixed with concentrates. In some systems, where it is possible to do so, the concentrates are also chilled prior to the making of beverages.

In furtherance of the above, the prior art has long provided beverage dispensing machines and systems that operate to receive water and concentrate from remote water and concentrate supplies, chill the water and deliver metered volumes of chilled water and concentrates, by means of suitable valve means, to mixing and dispensing heads, beneath which drinking glasses or the like are placed to be filled with beverages, as circumstances require.

In most, but not all instances, the beverages are established of five parts of water to one part of concentrate.

The commonly recognized mean temperature of the environment in which beverage dispensing machines are used and the commonly recognized mean temperature of the water and concentrates handled by beverage dispensing machines is 72° F. It has been determined that the temperature at which beverages can be most effectively and efficiently dispensed is approximately 45° F. Accordingly, beverage dispensing machines should operate to lower the temperature of water and concentrates approximately 27° F. if beverages dispensed thereby are to be at or about 45° F.

As the temperature of beverages increases above 45° F., their character (taste, texture and feel, etc. ) and their marketability decrease at an exponential rate.

It is common practice to place a minimum amount of cubed ice into the glasses in which beverages are served to enhance their appeal and marketability and to maintain the beverages suitably chilled (not to chill the beverages). If beverages, when dispensed into glasses containing ice, are notably warmer than 45° F., the ice melts so rapidly that it often fails to chill the beverages adequately; and, adversely dilutes the beverages.

When beverages, at 45° F., are dispensed into glasses containing ice, the rate at which the ice melts is sufficiently slow that the quantity of ice that need be used is minimal and the ice does not melt to an extent that the beverages are unduly diluted, before they are consumed.

In addition to the foregoing, ice is costly and is both troublesome and inconvenient to work with. Accordingly, for economic and other practical reasons, most commercial vendors of beverages seek to minimize the use of ice.

At this time the prior art provides self-contained beverage mixing and dispensing machines that are sufficiently small and compact so that they can be advantageously placed upon counter tops in cafes, diners, lunch stands, and the like. Those prior art machines are commonly referred to as "counter top machines." For practical reasons, counter top machines are typically made so that they include means for chilling water delivered thereto from approximately 72° F. to approximately 40° F. The chilled water is mixed with non-chilled concentrate to produce and dispense finished beverages at about 45° F. For reasons that will be made apparent in the following, ordinary counter top machines are made to deliver finished beverages at a maximum rate of about 1,200 ounces per hour, which equates to four 5-ounce individual servings per minute.

The above-noted beverage dispensing capacity of the great majority of counter top machines is established by the capacity of the water-chilling means that is incorporated in the machines, to cool or chill the water.

With possible rare exceptions, the water-chilling means used in counter top machines are what are sometimes referred to as water bath chillers and that are most commonly called "ice bank chillers." Ice bank chillers are characterized by open (non-sealed) tanks filled with coolant water; water-cooling coils are arranged within the outer perimeters of the tanks; refrigeration expansion coils are arranged centrally within the tanks and in spaced relationship from the water-cooling coils; and, refrigeration machines at the exteriors of the tanks and of which the expansion coils within the tanks, are a part.

When ice bank chillers are in operation, a bank of ice forms about the expansion coils in the tanks and water conducted through the water coils is chilled by the transfer of heat through the cooling water in the tanks that occurs between the water coils and the ice banks. Due to the fact that ice is a very poor conductor of heat and due to the fact that the ice banks in ice bank chillers are grown from the inside (coils) outwardly to the coolant water, it typically takes in excess of four hours for a useable bank of ice to be built up in ice bank chillers. The design and functioning characteristics of ice bank chillers are such that they cannot be used to chill and distribute water until an ice bank is fully established. In the event that excess volumes of water are conducted through the water coils in ice bank chillers, the ice banks melt down and are reduced so that the ability of the chillers to adequately chill water conducted therethrough is notably reduced. When the foregoing occurs, the beverage dispensing machines with which the ice bank chillers are related must be put out of service for a sufficient period of time to allow the ice banks to be restored or to grow to their desired operating size. Due to the fact that the ice banks grow outwardly from about their centrally located evaporator coils and the ice generated thereby has a low index of thermal conductivity, once the ice banks have melted to an extent that the chiller's ability to adequately chill the water conducted therethrough, it often takes well in excess of two hours for the ice banks to be regenerated; during which time no beverage can be dispensed from the beverage dispensing machines.

In practice, it is not infrequent that beverages are dispensed from counter top machines into common 64-ounce serving pitchers. The filling of one such pitcher causes water to be conducted through the ice bank chillers at several times the rate that the chillers are designed to accommodate. Accordingly, if several such pitchers are filled with beverage in a short period of time during which a machine is otherwise operated to dispense 4-ounce servings of beverage at a rate the machine is designed to dispense beverages, the ice bank of the ice bank chiller is highly likely to be melted down to an extent that the machine must be put out of operation for a protracted period of time to allow the ice bank to be restored or regenerated.

When the above occurs, many vendors equipped with prior art counter top machines seek to compensate for the inability of the machines to dispense adequately chilled beverages by placing more and excess ice in the serving glasses. This results in the dispensing of short servings of diluted beverages that displease customers and adversely affect their business.

It is to be noted that due to the space that is normally available to accommodate counter top machines and due to the resulting maximum practical size of those machines, the ice bank chillers that can be accommodated and used therein are those chillers that are rated at from 8 pounds to 12 pounds; that is, chillers having a water-chilling capacity that is equal to an 8 to 12-pound block of ice. Further, the refrigeration machines of ice bank chillers used in counter top machines are typically ⅓-horsepower refrigeration machines charged with Freon R-12. Laws recently connected require that the use of Freon R-12 be discontinued and that Freon R-134A be used in place thereof. The cooling capacity of Freon R-134A is but a fraction of the cooling capacity of Freon R-12. As a result of the foregoing, when the use of Freon R-12 is phased out and Freon R-134A is used, the water-cooling capacity of those ice bank chillers now used in counter top machines will necessarily be greatly reduced. It is anticipated that when the above takes place, the use of ice bank chillers in counter top machines will have to be discontinued. In those instances where counter top beverage dispensing machines cannot deliver sufficient volumes of adequately chilled beverages to meet the demands of beverage vendors, it is necessary that the vendors resort to the use of beverage dispensing systems that require more space, require more maintenance and that are notably more expensive than counter top machines. Some of those systems often include counter top cabinets that look much like counter top machines but that are supplied with chilled water from separate and remote water chillers. Those water chillers are, for example, stored in cabinets below the counter tops on which the cabinets are supported. Typically, the water chillers in such systems are large capacity ice bank chillers that are substantially larger, heavier and more costly than those ice bank chillers that are of a size and weight that they can be accommodate within the counter top cabinets. Further, when it is required that beverage making and dispensing systems utilizing separate water chillers be provided, the provision and use of separate and remote concentrate supply means are typically resorted to; since the notable advantages that self-contained counter top machines provide have been lost.

In accordance with the foregoing, there is a great need for a self-contained counter top beverage dispensing machine that operates to deliver greater quantities of beverage at notably lower temperatures than those counter top machines provided by the prior art can deliver. More particularly, as a result of the phasing out of the use of Freon R-12 and the phasing in of the use of Freon R-134A, there is a noted and urgent need for a greatly improved water-chilling means utilizing a refrigeration machine charged with Freon R-134A that is so small and compact that it can be incorporated in self-contained counter top beverage dispensing machines and that has the capacity to chill sufficient volumes of water to enable those counter top machines with which it is related to dispense sufficient volumes of sufficiently chilled beverages to meet vendors' demands.

OBJECTS AND FEATURES OF THE INVENTION

It is an object of this invention to provide a fully self-contained counter top beverage dispensing machine that is capable of continuously dispensing beverages at a temperature of approximately 35° F. and at a rate of approximately 1,800 ounces per hour; which equates about six—5-ounce servings per minute.

It is an object and feature of the invention to provide a machine of the general character referred to above that includes novel water-chilling means in the form of a sealed heat exchanger water tank with a related refrigeration machine that is charged with Freon R-134A and that is sufficiently small and compact so that the tank and its related refrigeration machine can be positioned within the cabinet structure of a standard size counter top beverage dispensing machine, together with a concentrate supply and delivery means and with the other liquid-handling components and parts of the machine.

It is yet another object and feature of the invention to provide a machine of the character referred to above wherein the water-chilling means is such that when it is first put into operation, it operates to reach that condition where water chilled to 35° F. can be dispensed therefrom in approximately 20 minutes.

Another object and feature of the invention is to provide a counter top machine with a water-chilling means of the character referred to above that operates to effectively and efficiently chill the concentrate supply and delivery means and the other liquid-handling components and parts of the machine so that the temperature of beverage dispensed by the machine is not elevated by the use of non-chilled concentrate.

Yet another object and feature of the invention is to provide a beverage dispensing machine of the general character referred to above wherein the water-chilling means includes a sealed stainless steel tank through which potable water to be chilled and dispensed is circulated and within which an elongate stainless steel evaporator coil of the refrigeration machine is arranged to chill the potable water that is circulated about it.

Still further, it is an object and feature of the invention to provide an improved beverage dispensing machine of the general character referred to above wherein the water-chilling means includes water pump means to continuously circulate water chilled in the tank in and throughout the tank and about the evaporator coil therein.

It is an object and feature of the invention to provide a machine of the general character referred to above that further includes a chilled water-conducting cooling coil connected with the water pump means and the tank and through which chilled water circulating through the tank is bypassed and which is positioned to effect chilling of the concentrate supplies and liquid-handling components and parts of the machine.

An object and feature of the invention is to provide an improved water-chilling means of the general character referred to above that includes a normally closed pressure-actuated switch in the power supply to the refrigeration machine that is responsive to the pressure within the tank and that operates to open when the pressure in the tank is increased to a set maximum pressure by the growth of ice about the evaporator coil in the tank and so that the growth of excess ice in the tank that might adversely affect the integrity and/or operation of the chiller means is prevented.

It is another object and a feature of the invention to provide an improved beverage dispensing machine of the general character referred to above that includes novel means to prechill and introduce water into the tank to replace water that has been dispensed therefrom.

The above and other objects and features of the invention will be fully understood from the following detailed description of one typical preferred form and embodiment of the invention throughout which description reference is made to the accompanying drawings.

DETAILED DESCRIPTION OF THE INVENTION

Figure 1:
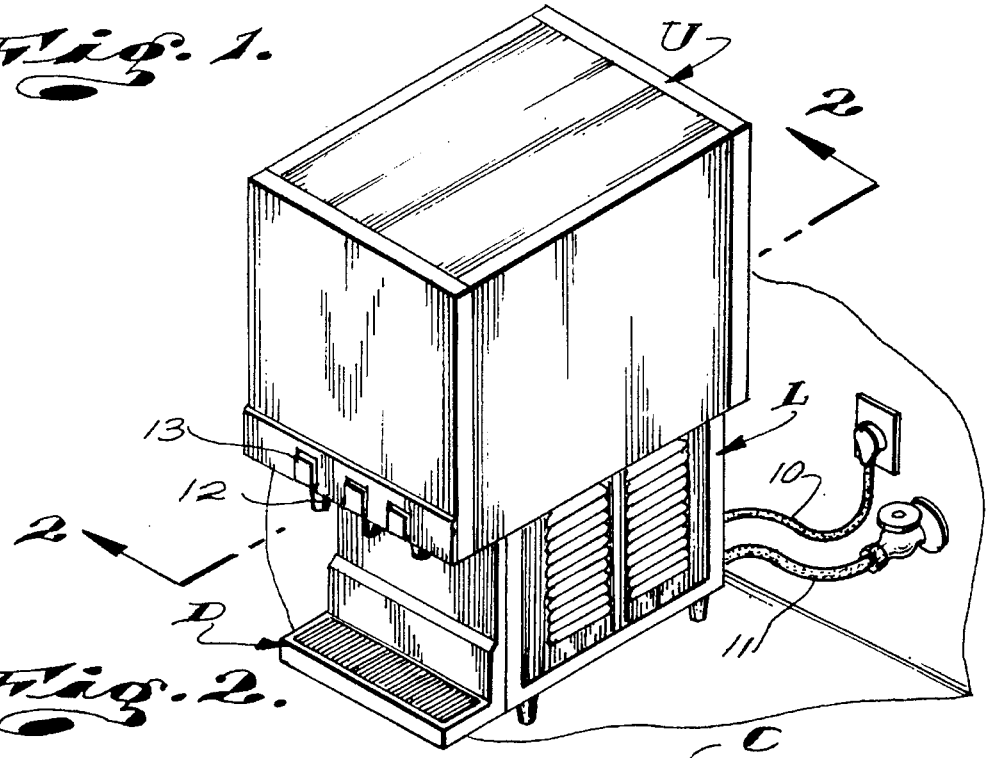
FIG. 1 is an isometric view of a counter top beverage dispensing machine embodying the present invention.

In FIG. 1, a typical self-contained counter top beverage dispensing machine embodying the invention is shown. The machine includes a lower box-like cabinet or housing section L, formed of sheet metal and in which parts of a refrigeration machine and certain other parts of the beverage dispensing machine are housed. The section L has a forwardly projecting and upwardly disposed drip tray D extending transverse and projecting forwardly from the lower portion of a front wall of the section. The machine next includes an upper thermally insulated box-like housing section U that is positioned atop the lower section L and in which beverage concentrate supplies and liquid-conducting parts, including our new heat exchanger water tank T and a related cooling coil C, are positioned to chill water and concentrate for making and dispensing chilled beverages.

A power cord 10 and a flexible water supply hose 11 extend from the machine and are shown connected with a common electric power receptacle and a hose bib valve of a pressurized water supply system, such as a pressurized municipal water supply system that delivers water at, for example, 45 psi.

The lower forward portion of the upper section U projects forwardly from the upper forward portion of the lower section L to overlie the drip tray D in vertical spaced relationship therewith. The lower forward portion of the section U carries a plurality (3) of laterally spaced downwardly opening beverage dispensing spouts or tubes 12 and related forwardly disposed manually engageable push-button switches 13, each of which is operable to effect the dispensing of beverage from its related tube 12. The tubes 12 are shown as parts of mixing blocks B positioned within the forward portion of the housing section U.

The machine, as shown, is such that anyone of three different flavors of beverages can be dispensed into serving glasses set upon the drip tray, beneath a selected tube 12.

In practice, the cabinet or housing of the machine is made as small and as compact as is possible. The various components and parts are arranged in the cabinet and relative to each other as closely as possible and as circumstances require. Further, to meet customer requirements and needs and for other practical reasons, different makes and models of components and/or parts are often used. Those different makes and models of components and parts often vary in size and configuration and it is necessary that the arrangement of parts in the machine be varied accordingly. Finally, machines made to dispense different numbers of beverages include different numbers of parts, which require modifying and/or altering the arrangement of those parts. As a result of the foregoing, the production of clear and easy-to-read patent drawings showing one particular model of our machine could not be produced without unduly burdening this disclosure with an undue number of drawings. Accordingly, in FIG. 2 of the drawings, one typical arrangement of parts that might be employed is illustrated.

Figure 3:
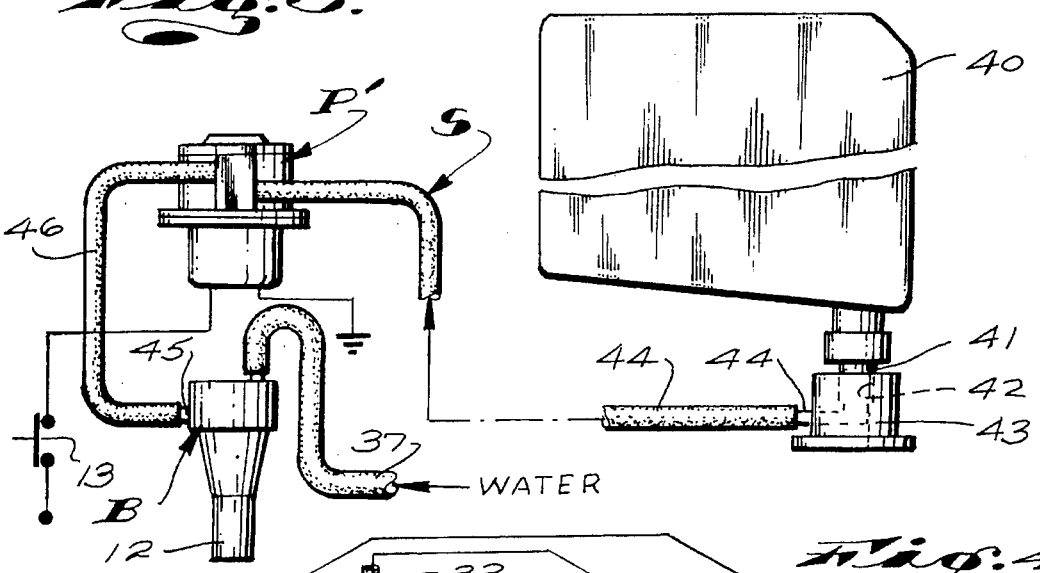
FIG. 3 is a diagrammatic view of the beverage concentrate system.
Figure 4:
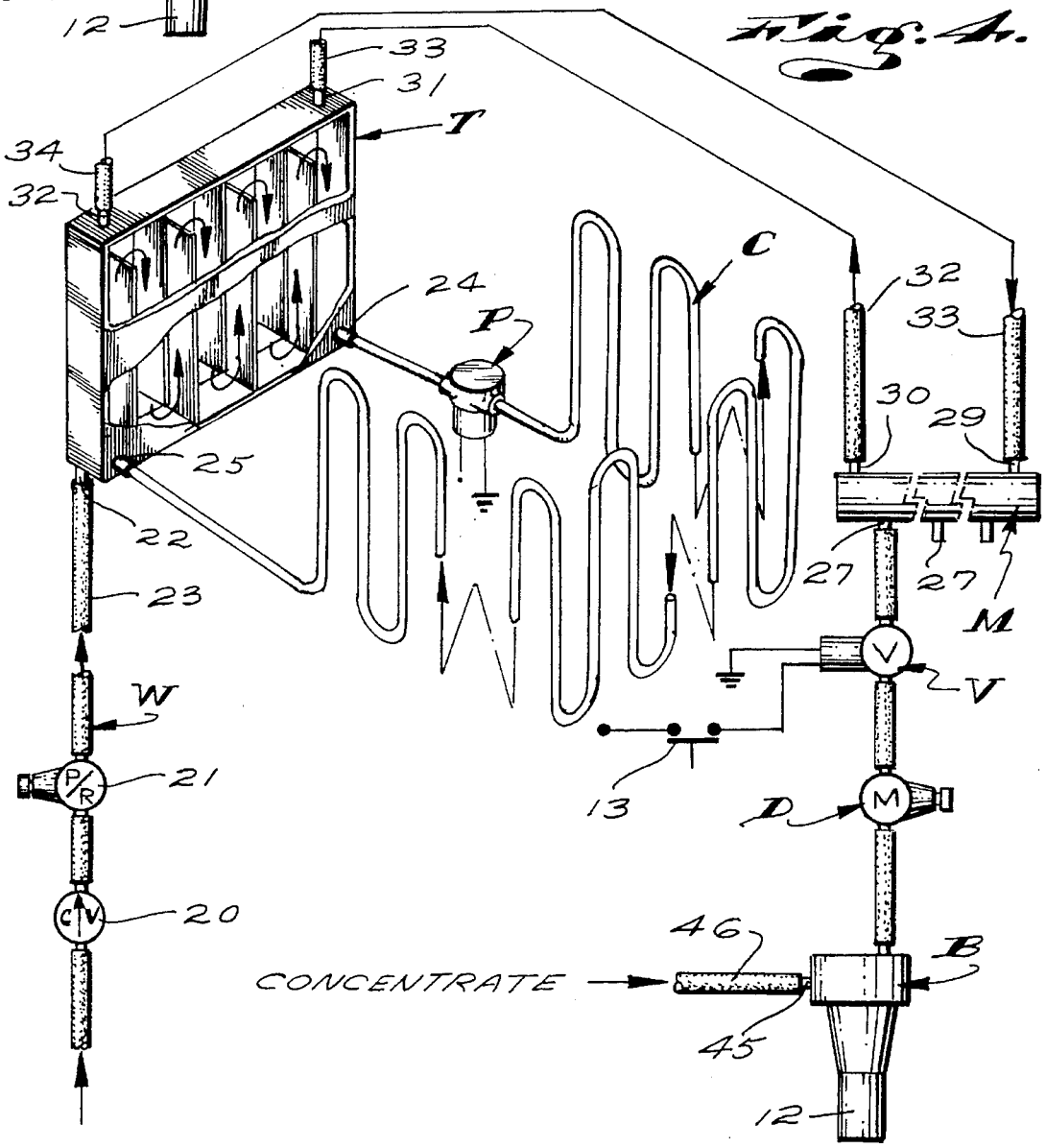
FIG. 4 is a diagrammatic view of the water system.
Figures 5, 6, 7:
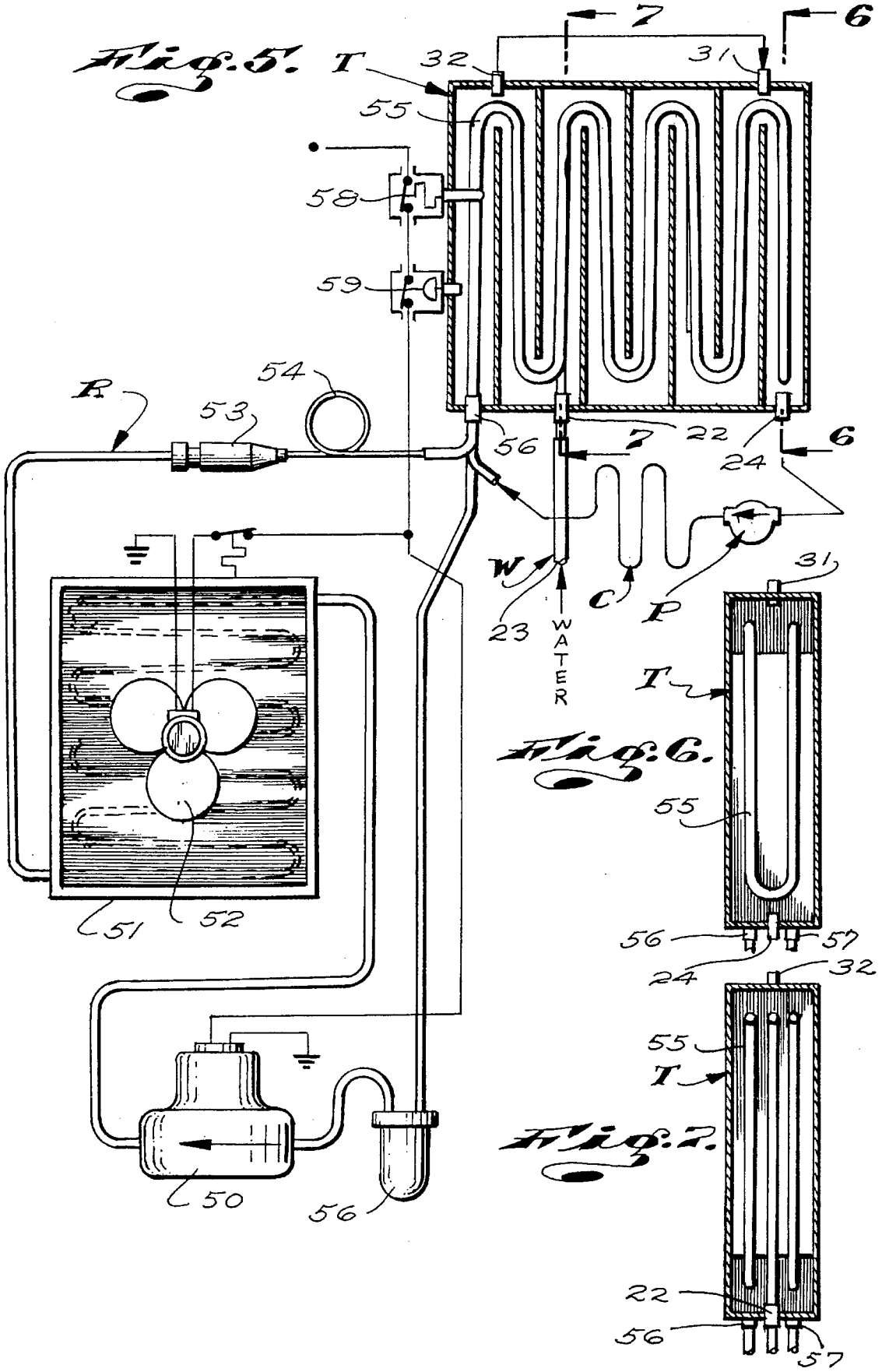
FIG. 5 is a diagrammatic view of the refrigeration system.
FIG. 6 is a view taken substantially as indicated by Line 6—6 on FIG. 5.
FIG. 7 is a sectional view taken substantially as indicated by Line 7—7 on FIG. 5.

In FIGS. 3, 4 and 5 of the drawings, the concentrate, water and refrigeration systems of the machine have been separately, diagrammatically illustrated. In FIGS. 8 through 11 of the drawings, details of construction of the water tank are illustrated.

Referring first to FIG. 4 of the drawings, the machine includes a water-handling system or means W that first includes a check valve 20 positioned in the lower housing section L and that is suitably connected with the water supply hose 12 that extends from the water service system. The system W next includes a pressure regulator 21 downstream of the valve 20 and positioned within the lower housing section L. The system W next includes our new heat exchanger water tank T. The tank T is positioned within a chamber X defined by thermally insulated walls of the upper housing section U. The tank has a water inlet fitting 22 (see FIG. 9 of the drawings) that is suitably connected with the downstream side of the pressure regulator by a fluid line 23. The tank T is a substantially flat rectilinear unit and is positioned in the chamber X adjacent to and in flat engagement with a flat, vertical, thermally insulated rear wall of the housing section U.

The system W next includes a pump P that is shown positioned within the chamber X. The pump P is driven by a pump motor that is positioned in the lower housing section. The pump P and its motor are connected by a shaft that extends through a bottom wall of the housing section U. The pump P has an inlet or suction side that is suitably connected with a water-circulating outlet fitting 24 at one portion of the tank T and an outlet or discharge side that is suitably connected with the downstream end of an elongate cooling coil C that is arranged to extend throughout the interior of chamber X in the housing section U. The other end of the coil C is suitably connected with a water recirculation return fitting 25 at a portion of the tank that is remote from the fitting 24.

The coil C is serpentine in form and is positioned in the chamber X to occur adjacent to and to extent laterally and vertically across the inside surfaces of the insulated side and front walls of the housing section U defining the chamber.

The pump P operates continuously and maintains constant circulation of water in and through the tank T and in the coil C.

Figure 2:
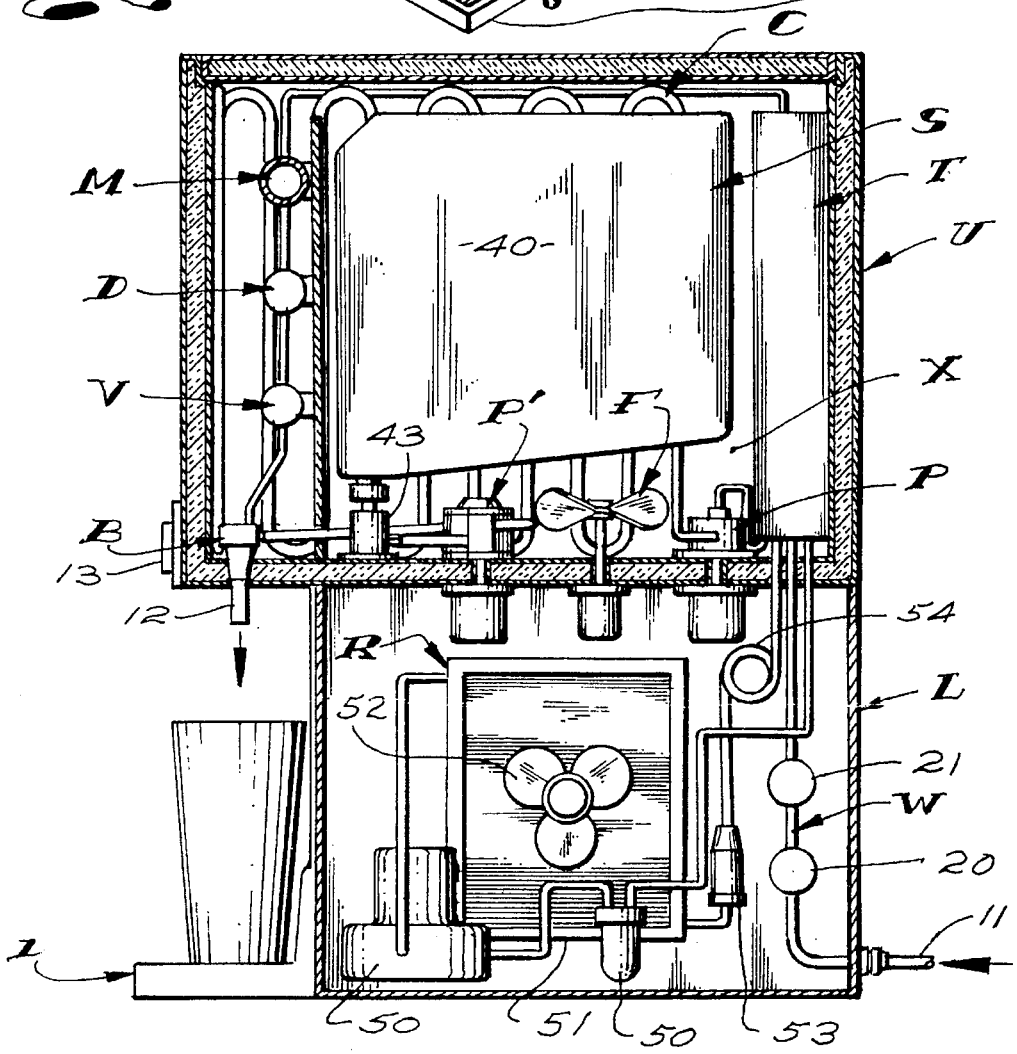
FIG. 2 is a sectional view taken substantially as indicated by Line 2—2 on FIG. 1.

The water system W next includes a manifold M mounted on the upper portion of a vertical mounting plate 26 in the forward portion of the chamber X, as shown in FIG. 2 of the drawings. The manifold M is shown as having three outlet fittings 27, each positioned to occur above a related valve V and flow metering device D.

The manifold has water inlet and return fittings 29 and 30 that are connected with water delivery and return fittings 31 and 32 on the tank T, by lines 33 and 34. The connections between the tank T and the manifold M are such that a continuous recirculation of chilled water from within the tank to the manifold and from the manifold back into the tank is maintained.

The means W next includes a normally closed electrically actuated water control valves V for each flavor of beverage to be made and dispensed and that is carried by the mounting plate 26. Each valve V is suitably connected with the manifold M, and is suitably connected with a related water-metering device D. The device D is suitably connected with a water inlet of a related mixing block B. The several valves V, metering devices D and blocks B are carried by the mounting plate 26 within the housing section U. A discharge tube or spout 12 related to each block B extends through an opening in the insulated bottom wall of the housing section U.

It is to be noted that if the machine is to dispense one flavor or beverage, the manifold M can be eliminated and but one device D, valve V, mixing block B, tube 12, and switch 13 are provided.

Each valve V is under control of its related push-button switches 13 that is accessible at the front of the machine. When a switch 13 is closed, its related valve V opens and a metered flow of water is delivered through its related metering device to its related mixing block B.

Next, referring to FIG. 3 of the drawings, the machine includes a concentrate supply and delivery means S for each flavor of beverage to be made and dispensed. Each means S includes a concentrate bottle 40 removably positioned within the compartment X. The bottle 40 can, for example, hold 2 gallons of concentrate (sufficient to make in excess of 10 gallons of finished beverage). The bottle 40 is preferably a standard bottle that is specially formed for engagement and use in beverage dispensing machines. Such standard bottles are made so that a plurality of bottles can be advantageously arranged in side-by-side relationship with each other and occupy a minimum amount of space.

Each bottle has a depending neck that carries a discharge spout 41 that depends from the lower forward portion of the bottle. The spout 41 is releasably engaged in an upwardly opening socket opening 42 in a bottle coupling inlet fitting 43.

The spout 41 on the bottle 40 is normally closed by spring-loaded check valve (not shown) that is opened by a part in the fitting 43 when the spout is fully engaged in the socket opening 41. This enables the bottle to be inverted for the purpose of moving it into and out of engagement with the fitting 43, without spillage of concentrate therefrom. The bottle has a normally sealed air vent (not shown) that is unsealed when the bottle is inverted and that vents the bottle and allows for the free flow of concentrate therefrom.

One wall of the housing section U, for example the top wall, can be hingedly or otherwise mounted so that the chamber X can be opened and to enable movement of concentrate bottles into and out of working position in the machine, as circumstances require.

Each fitting 34 has a concentrate outlet 44' that is suitably connected with the suction sides of related peristaltic pumps P' (or equivalent pump) by lines 44. In one preferred embodiment of the invention, the pump P' is mounted in the chamber X atop the bottom wall of the upper housing section U and is driven by a shaft that extends through the bottom wall to a motor in the lower housing section L.

The discharge or downstream sides of the pump P' is shown connected to a concentrate inlet 45 on its related mixing block B by a line 46.

Each of the concentrate pumps P' is connected with its related push-button switches 13 at the front of the machine so that when the switch is closed and a metered flow of water is delivered to its related mixing blocks B, a metered flow of concentrate is also delivered to the block B; to mix with the water delivered thereto to establish a finished beverage. The finished beverage is dispensed through the tube 12 that depends from the block.

Next, referring to FIG. 5 of the drawings, the machine includes a refrigeration machine R that operates to chill water in the tank T. The machine R is shown as a capillary-type refrigeration machine and includes a motor-driven compressor 50; a condenser 51 downstream of and connected with the discharge of the compressor; a motor-driven fan 52 is related to the condenser; a filter-dryer 53 is positioned downstream of and is connected with the condenser; a capillary tube 54 is downstream of and is connected with the filter-dryer; an evaporator coil 55 is downstream of and is connected with the capillary tube; and, an accumulator 56 is downstream of and is connected with and between the evaporator coil and the inlet or suction side of the compressor. Except for the evaporator coil 55, all of the parts 50 through 54 and 56 of the refrigeration machine are mounted within the lower housing section L. The evaporator coil 55 is positioned within the water tank T that is in the chamber X of upper housing section U.

The evaporator coil 55 is formed of stainless steel and has opposite end portions that extend out from within the tank T through fittings 56 and 57 and that are suitably connected with their related parts of the refrigeration machine.

It is to be particularly noted that the refrigeration machine is charged with Freon R-134A and the compressor is but a ⅓-horsepower unit.

The power to the compressor 50 is controlled by a normally closed, capillary tube and bulb-type or thermistor-type thermo-responsive switch 58 that is engaged in the power line to the compressor. The bulb or thermistor for the switch 58 is positioned within a stainless steel receiver tube that extends through a wall of and into the tank T. The normally closed switch 58 is adjusted and set to open and to put the refrigeration machine out of operation when the temperature of the water in the tank drops below a desired set operating temperature. 8 Power to the compressor 50 is also controlled by a normally closed pressure-actuated switch 59. The switch 59, as shown in FIG. 5 of the drawings, is connected with and carried by the tank T, but can be connected in other positions within the system W, if desired or if circumstances require. The switch 59 is responsive to pressure within the tank and is adjusted and set to open when the pressure in the tank T is increased above the maximum operating pressure of the system (set by the pressure regulator 21) as a result of an excess growth of ice on and about the evaporator coil 55 in the tank T. More particularly, the switch 59 is set to open below that pressure where the flow of water through the tank might be adversely affected and below those pressures at which the tank and each of the other parts in and through which the water flows might be damaged. Accordingly, the machine can be set to chill the water at close to freezing (32° F.) without generating so much ice in the tank T to cause an increase in pressure that might bring about adverse results.

In practice, when the machine is operating at its maximum, the switch 58 might be set to open at temperatures near to freezing (32° F.). Under such circumstances, operation of the machine is controlled by the pressure-actuated switch 59 alone.

It is to be noted that when the refrigeration machine is turned off by the switch 58 or by switch 59, the water circulation pump P continues to operate and maintains a circulation of water through the tank T, coil C and manifold M. Should the refrigeration machine be turned off by switch 59, as a result of excess ice forming within the tank, the continuously circulating water in the tank rapidly melts the excess ice and results in the lowering of the pressure in the tank to acceptable operating pressure in a minute or two.

It is to be noted that the check valve 20, downstream of the pressure regulator 21, prevents back flow of water in the machine and assures that if excess ice grows in the tank, the pressure within the tank will increase. The normally closed valve V(s) downstream from the tank T normally prevent a loss or drop in pressure in the tank T that would prevent the switch 59 from functioning as intended.

Finally, in the preferred carrying out of the invention, an air-circulating fan F can be and is shown mounted in the chamber X in the upper housing section U to maintain the air in the chamber X in constant circulation about all of the elements and parts of the machine that are within the chamber. The circulation of air assures fast, effective and uniform heat exchange and cooling of all that is within the chamber.

In operation, the water in the tank T is chilled by the refrigeration machine; the chilled water is continuously recirculated through the tank T and the coil C, both of which are within the chamber X of the thermally insulated upper housing section U and in which the concentrate supply (bottles) and other liquid-handling components and parts of the machine are positioned. The tank T and coil C, with assistance from the fan F effectively chill and maintain all of that which is within the chamber chilled. When the machine is operating to dispense a serving of beverage, chilled concentrate and water are conducted from a bottle 20 and tank T into a mixing block B and chilled beverage drains or flows from the mixing block, through its related dispensing tube 12, and into an awaiting glass. As chilled water is used and dispensed, as noted above, a pressure drop occurs that causes replacement water to flow into the tank. The replacement water is chilled at a rate that is sufficiently fast so that little perceptible elevation in the temperature of the water in the tank is likely to occur.

In practice, the ⅓-horsepower refrigeration machine charged with Freon R-134A, in combination with the tank T, effects chilling of water circulating in the tank T, coil C, manifold M and their related liquid-handling parts within the chamber X, from 72° F. to between 30° F. and 35° F. in from 20 to 22 minutes and thereafter will support the continuous making and dispensing of beverage at about 35° F. and at a rate of about 1,800 ounces per hour. Accordingly, the machine is capable to dispensing in excess of six—5-ounce servings of beverage per minute; 24 hours per day. When concentrate bottles are replaced and, should the capacity of the machine to dispense chilled beverages be exceeded at any point in time, it will return to its set operating temperature in a small fraction of the 20 minutes that is required to lower the operating temperature of the chiller from ambient temperature (72° F.) to its set operating temperature.

In addition to the above, the size and weight of the water tank T, coil C and manifold M, when filled with water, is a fraction of the size and weight of the water-handling parts of a 12-pound ice bank water chiller.

Next, referring to FIGS. 8 through 11 of the drawings, the heat exchange water tank T is of novel design and construction. The tank T is a rectilinear tank structure made of stainless steel sheet metal. The tank T, as shown, has flat vertical front and rear walls 60 and 61, flat vertical right- and left-hand side walls 62 and 63 and flat horizontal top and bottom walls 64 and 65. Each of the walls has flat oppositely disposed inside and outside surfaces. The side wall 62 is formed integrally with and projects rearwardly from its related edge of the front wall and the side wall 63 is formed integrally with and projects forwardly from its related edge of the rear wall. The rear edge of the side wall 62 and front edge of the side wall 63 overlie flanges 66 formed on their related edges of the rear and front walls. The walls 62 and 63 and flanges 66 and are first spot-welded together and are thereafter sealingly fixed together by welding.

The front and rear walls 60 and 61 are formed with a plurality of laterally spaced vertically extending, outwardly projecting and inwardly opening U-shaped channel portions 67 having laterally spaced side walls 68 and that define inwardly opening channels 69. The channels 69 in the front wall are aligned and oppose channels 69 in the rear wall.

The top and bottom walls 64 and 65 are rectilinear in plan configuration and are formed with vertical flanges 70 about their perimeters that oppose and establish flat engagement with related inside surfaces of the front, rear and side walls and to which they are first spot welded and thereafter sealingly fixed by welding.

In addition to the above, the top wall 64 has fixed to it and carries a plurality of flat vertical upper partitions 71 with vertical front and rear edge portions and top and bottom edges. The partitions 71 are substantially equal in lateral extent with the distance between the bottoms of related pairs of opposing channels 69 in the front and rear walls and are less in vertical extent than the distance between the top and bottom walls a distance that is substantially equal to the distance between the laterally spaced pairs of channels. The number of partitions 71 is equal to one-half the number of pairs of channels and are spaced apart such that when the top plate is in position, the front and rear edges of the partitions enter related pairs of channels 69 in the front and rear walls to extend longitudinally thereof and laterally therebetween. When the top wall 64 and its partitions 71 are fully engaged within the front, rear and side walls of the tank, their lower ends terminate in spaced relationship above the bottom wall 65 of the tank.

The top edges of the partition 71 are formed with horizontal flanges that abut the inside surface of the top wall and are fixed thereto by spot-welding.

The bottom wall 65 is similar to the top wall 64 and carries lower partitions 72 that are similar to the partitions 71. The bottom wall 65 and its related partitions 72 establish a subassembly that is substantially identical with the subassembly established by the top wall 64 and partitions 71, but which is inverted so that the partitions 72 project upwardly from the plate 65 and that is turned end-for-end so that the partitions 72 register with those pairs of channels 69 in the front and rear walls that occur next to or between those pairs of channels in which the partitions 71 are engaged.

When the top and bottom walls 64 and 65, with their related partitions 71 and 72, are fully engaged and in set position with the front, rear and side walls of the tank, the several related walls and partitions define a zig-zag or serpentine water-conducting passage 80 throughout the interior of the tank T. In the case illustrated, the water passage 80 has an upstream end that starts at the left-hand end of the bottom wall 65 and a downstream end that terminates at the right-hand end of the bottom wall 65. The passage 80 is rectangular in cross-section and, in the case illustrated, has a major dimension that extends laterally between the front and rear walls.

The evaporator coil 55 of the refrigeration machine that occurs within the tank is serpentine in form and has an upstream portion that enters the upstream end of the passage 80 through the fitting 56 in the bottom wall 65. The upstream portion of the coil 55 extends through the passage 80 to the downstream end thereof where it joins with a serpentine-formed downstream portion of the coil that continues from the downstream end of and back through the passage 80 to the upstream end of that passage, where it exits the tank through the fitting 57 in the bottom wall. That is, the coil 55 is an elongate serpentine coil that has a downstream portion extending downstream through the passage 80 and an upstream portion that extends upstream through the passage 80. With this combination and relationship of parts, the coil 55 chills the water flowing through the passage 80 in a uniform manner, from one end thereof to the other and is designed and constructed so that the cooling capacity of the refrigerant flowing through the coil 55 is most effectively and efficiently utilized.

The end portions of the stainless steel coil 55 that project through the fittings 56 and 57 extend to and are connected with their related capillary tube 54 (or expansion valve) and accumulator 56 in accordance with common practices.

In one preferred carrying out of my invention and as shown, the tank T includes a novel water inlet means. That means includes an elongate water-conducting tube 85 with an inlet or downstream end portion that extends through the fitting 23 in the bottom wall of the tank and that is suitably connected with the downstream side of the pressure regulator 21 by a water delivery line 23. The tube 85 has a downstream end portion that is of serpentine form and extends longitudinally through a portion of the passage 80 in the tank. The downstream end of the tube 85 opens to deliver water into the flow passage 80 in the tank between the upstream and downstream ends thereof. With this relationship of parts, when the chilled water that is recirculating through the water passage 80 in the tank is used to make beverages and replenishment water, which is yet to be chilled, is introduced into the tank through the tube 85, the replenishment water, flowing through the tube 85, is progressively chilled as it advances downstream therethrough and is fully chilled when it is discharged into the flow passage 80 and joins with the previously chilled water flowing therethrough. Thus, the dumping of warm water into the flow passage 80 at any one point longitudinally thereof and that would create "hot spots" in the column of water flowing through the tank is prevented. In those instances where the tube 85 has not been provided, and unchilled replacement water is uncontrollably introduced into the tank at the fitting 23, undesirable fluctuations in the temperature of water dispensed from the tank have been observed to occur. Accordingly, in applicant's preferred embodiment of the invention, the tube 85 is included.

The tube 85 is preferably arranged in the flow passage 80 to occur between and in heat transfer engagement with the upstream and downstream portions of the coil 55 and such that water flowing through the tube 85 is, to a great extent cooled by the refrigeration flowing through the coil 55 rather than the water in the tank.

In practice, the upstream and downstream portions of the coil 55 and the tube 85 are held in predetermined spaced relationship relative to each other and relative to the walls of the tank and the partitions defining the flow passage 80 by a plurality of longitudinally spaced spacer parts (not shown) that engage and hold the coil and tube and that extend between and stop against the partitions and/or walls of the tank. The spacer parts can vary widely in form and construction. In practice, spacer parts of different design and established of stainless steel wire stock and/or sheet metal stock have proven to be quite satisfactory. It is only necessary that the spacer parts be formed so that they do not adversely interfere with the free flow of water through the passage 80 and about the coil 55 and tube 85. Since the form and construction of the spacer parts can vary widely in form and construction without in any way affecting the invention and since such spacer parts in no way affect the novelty of our invention, illustration and detailed description of those parts has been omitted.

Figure 8:
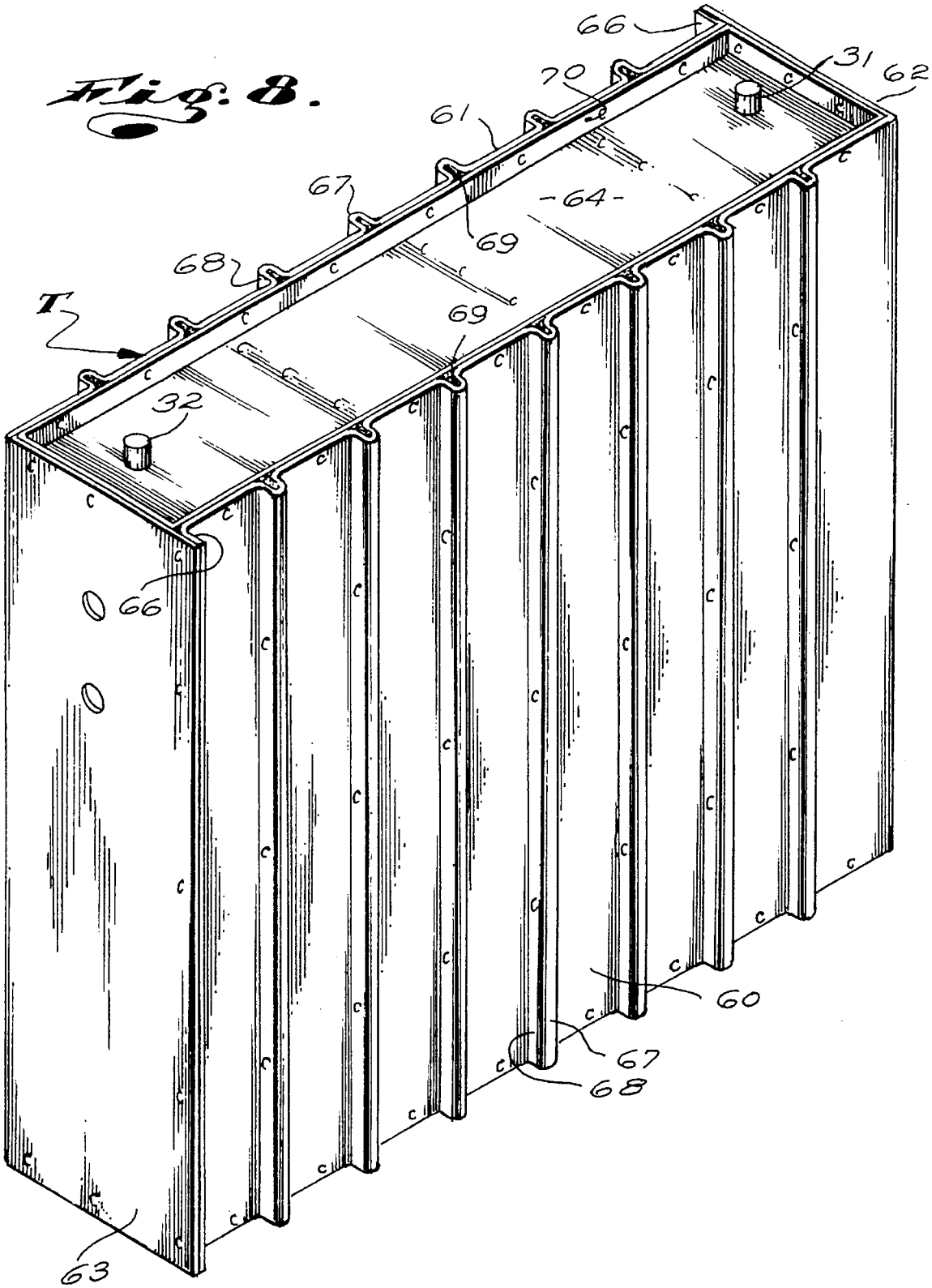
FIG. 8 is an isometric view of the water tank.
Figure 9:
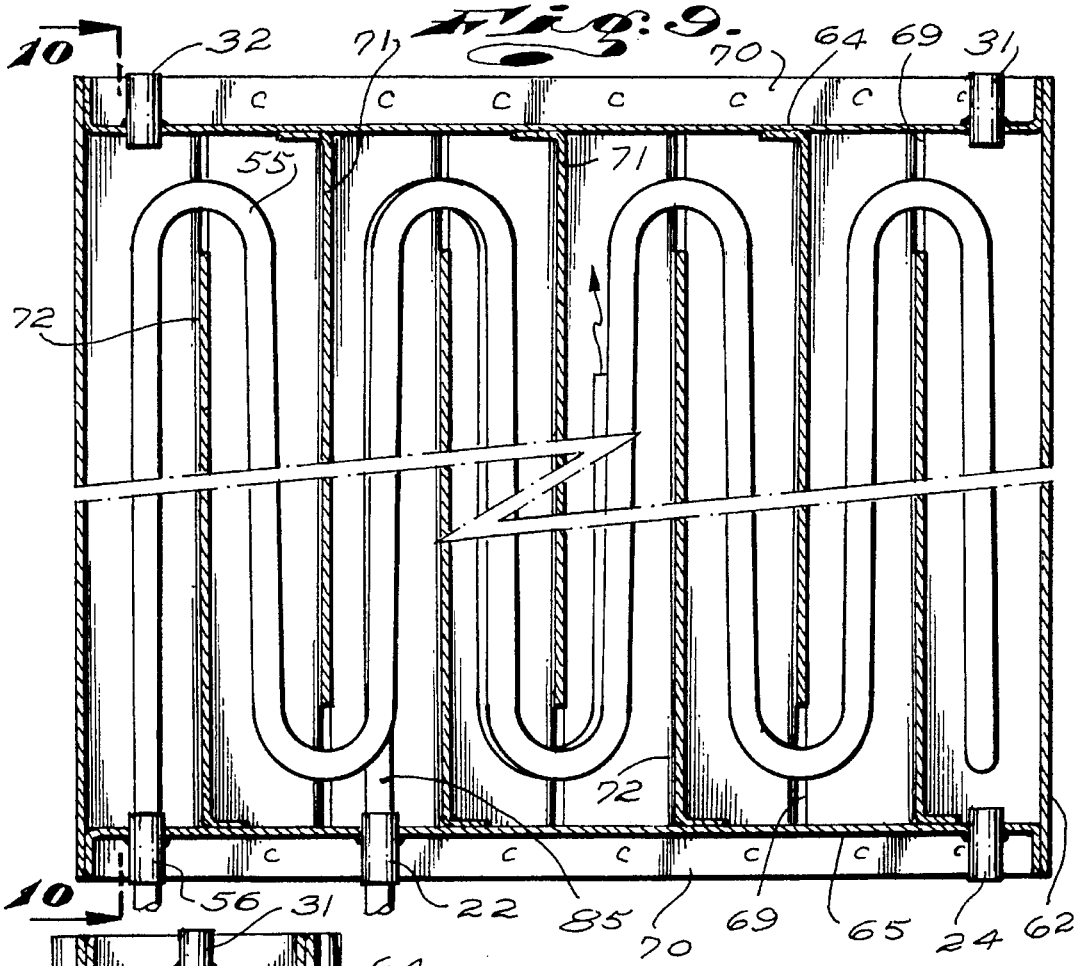
FIG. 9 is a sectional view of the tank.
Figure 10:
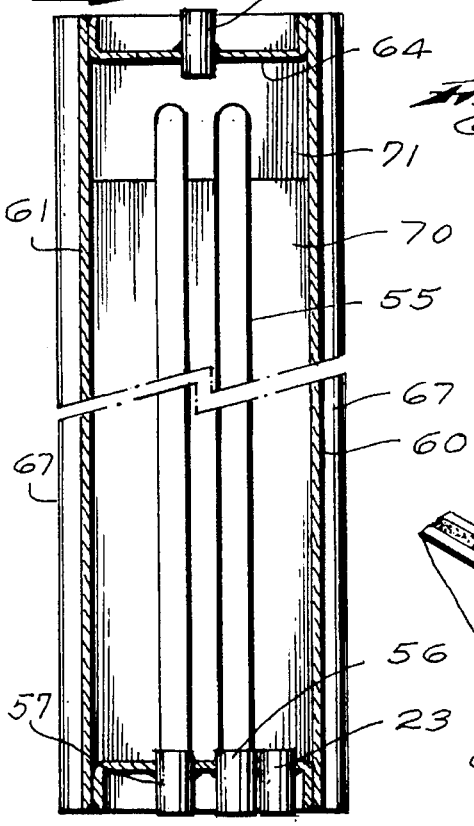
FIG. 10 is a sectional view taken substantially as indicated by Line 10—10 on FIG. 9; and, FIG. 11 is an isometric view of a corner portion of the tank.
Figure 11:
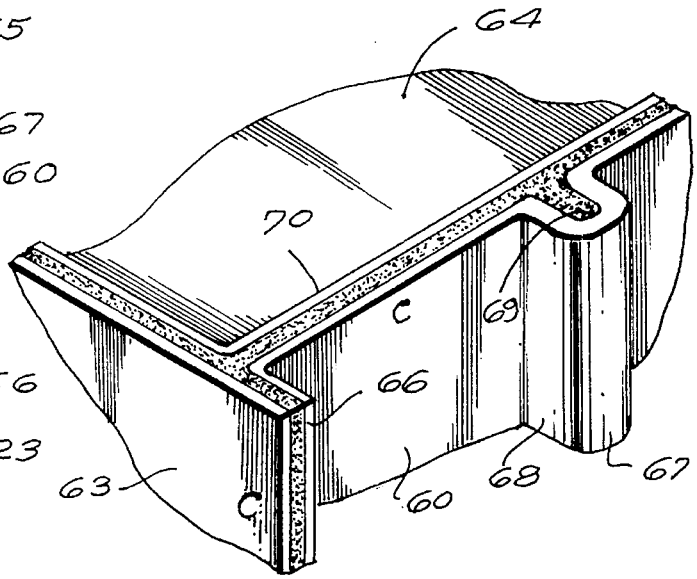

In FIG. 5 and in FIG. 8 of the drawings, the end wall 62 of the tank T is shown formed with openings to accommodate parts of the switches 58 and 59.

The top wall 64 of the tank carries fittings 31 and 32 with which the water-conducting lines 33 and 34, that extend to the manifold M, are connected. The fittings 31 and 32 are located so that the fitting 31 opens into the tank at the upstream end portion of the passage 80 and the fitting 32 opens into the tank at the downstream end of that passage. A differential in pressure on the water between the upstream and downstream ends of the flow passage, caused by friction loss, is sufficient to induce and sustain a circulation of chilled water through the manifold M.

The fittings 24 and 25 that serve to connect the pump P and coil C with the tank are shown positioned to communicate with the opposite, upstream and downstream ends of the passage 80.

When fabricating the tank T, the front, rear and side walls of the tank can be first assembled and suitably staked together by spot-welding. Next, the top wall and its related partitions can be engaged with the assembled top, bottom and end walls, the edges of the partitions can be spot-welded to the side walls 68 of their related channel portions 67. Next the flanges about the periphery of the top wall are spot-welded to the front, rear and side walls. Next, the evaporator coil 55 and tube 85, with spacers related to them, are assembled with the bottom wall and its related partitions to establish a subassembly that is entered into engagement with the previously assembled parts and that is fixed or tacked thereto by spot-welding. After the above-noted parts of the tank are assembled as noted, all exterior or outside joints and seams of the assembly are sealingly filled with and secured together by welding.

Finally, in the preferred carrying out of our invention, the assembled tank is subjected to a high temperature oven process during which all cracks, crevices and interstices in the tank are filled with metal to completely seal and bond the parts together. This process is commercially called hump oven welding and is not unlike sealing and/or bonding parts together by silver soldering.

During tests of the tank T, the tank has been completely filled with water and the water therein has been cyclically frozen and thawed in excess of 20 times (with water added, as necessary, to maintain the tank filled). Some bulging of the larger or more expansive wall portions of the tank has been observed to occur but the structural integrity and utility of the tank has in no way has been compromised. Thus our new tank structure is extraordinarily durable and capable of withstanding the occasional "freeze-ups" that might occur during intended and proper use of the tank.

Since all of the parts of the tank and all of the elements and/or parts of the machine that are fixed to and made a part of the tank are established of stainless steel, the potability of the water conducted into, through and from the tank and its related parts is in no way adversely affected.

In some beverage dispensing machines and in beverage dispensing systems in which the tank T is or might be used, the tank, being a flooded tank, can be turned to lie flat on what is described as its top or bottom wall, can be turned to lie on one or the other of its side walls or might simply be inverted; without adverse effects. Further, in practice, the positioning of the fittings and openings in the tank through which parts extend can be located or positioned in any one of several walls of the tank, as circumstances might dictate. Still further, the size or dimensions of the tank and the number of partitions and therefore the number of runs and turns in the flow passage 80 can be varied as circumstances require or as desired.

It is to be noted that the water-chilling means of this invention is suitable for use in any system where an abundant and substantially continuous supply of chilled water is needed and that its use in the beverage dispensing machine illustrated and described above is illustrative of but one use to which it might be advantageously put.

Having described only one typical preferred form and embodiment of the invention, we do not wish to be limited to the specific details herein set forth but wish to reserve to ourselves any modifications and/or variations that may appear to those skilled in the art and that fall within the scope of the following claims.

Having described our invention, we claim:

1. A beverage dispensing machine connected with an electric power supply and a pressurized water supply, said machine includes a water-chilling and delivery means, a liquid beverage concentrate supply and delivery means; a water and concentrate mixing means with a related beverage dispensing tube and connected with and receiving water and concentrate from the water-chilling and delivery means and the concentrate supply and delivery means; the water-chilling and deliver means includes an elongate pressure sealed water tank with upstream and downstream end portions, a water supply line connecting one end portion of the tank with the water pressurized water supply a check valve in the water supply line, a water delivery line connecting the other end portion of the tank with the mixing means; a normally closed electrically actuated water valve means connected in the water delivery line and operating to start and stop the flow of water from the water supply system to the mixing means; an electrical-powered refrigeration machine connected with the power supply and including an elongate expansion coil with upstream and downstream end portions at opposite end portions of the tank and extending throughout the tank, an electric-powered water pump with suction and discharge sides connected with opposite end portions of with the tank and operating to maintain water recirculating through the tank and about the expansion coil; the concentrate supply means includes a bottle of liquid concentrate, a concentrate delivery line extending between the bottle and the mixing means, an electric-powered concentrate pump in the concentrate delivery line to move concentrate from the bottle to the mixing means; and, a manually operable switch connected in the power supply to the valve means and concentrate pump and selectively operable to energize the concentrate pump and to open the valve means; and, a normally closed pressure-actuated switch in the power supply to the refrigeration machine and responsive to pressure in the tank and operating to open when the pressure in the tank exceeds a set maximum operating pressure.

2. The beverage dispensing machine set forth in claim 1 that further includes a normally closed temperature-responsive switch connected in the power supply to the refrigeration means and responsive to the temperature of the water in the tank and operating to open when the temperature of the water drops below a set operating temperature.

3. The beverage dispensing machine set forth in claim 1 that further includes a pressure regulator in the water supply line and a water-metering device in the water delivery line.

4. The beverage dispensing machine set forth in claim 1 that further includes a cabinet with a thermally insulated chamber in which the concentrate supply bottle is positioned and in which the tank is positioned to cool the concentrate in the bottle.

5. The beverage dispensing machine set forth in claim 1 that further includes a cabinet with a thermally insulated chamber in which the concentrate supply bottle is positioned and in which the tank and the water pump are positioned to cool the chamber and the concentrate in the bottle therein.

6. The beverage dispensing machine set forth in claim 1 that further includes an elongate cooling coil connected with and extending between one side of the water pump and the tank and through which water recirculating in the tank is conducted; and, a cabinet with a thermally insulated chamber in which the concentrate supply and delivery means are positioned and in which the tank and the cooling coil are positioned to cool the chamber and the concentrate supply and delivery means therein.

7. The beverage dispensing machine set forth in claim 1 that further includes an elongate cooling coil connected with and extending between one side of the water pump and the tank and through which water recirculated in the tank is conducted; and, a cabinet with a thermally insulated chamber in which the concentrate supply and delivery means, water valve and mixing means are positioned and in which the tank, the water pump and cooling coil are positioned to cool the chamber and parts therein.

8. The beverage dispensing machine set forth in claim 1 that further includes an elongate cooling coil connected with the extending between one side of the recirculating pump and the tank and through which water recirculated in the tank is conducted; and, a cabinet with a thermally insulated chamber in which the concentrate bottle, concentrate pump, water valve and mixing means are positioned and in which the tank water pump and cooling coil are positioned to cool the chamber and the parts of the machine positioned therein.

9. The beverage dispensing machine set forth in claim 1 wherein the tank is an elongate tank with a plurality of longitudinally spaced partitions defining an elongate substantially serpentine water-conducting passage with upstream and downstream end portions connected with the water supply and delivery lines, the expansion coil is arranged to extend longitudinally through the passage between its upstream and downstream end portions, the water inlet line is connected with the upstream end of the passage, the water delivery line is connected with the downstream end of the passage, the water pump is connected with and between the upstream and downstream ends of the passage.

10. A beverage dispensing machine connected with an electric power supply and a pressurized water supply system; said machine includes a water-chilling and delivery means, a liquid beverage concentrate supply and delivery means, water and concentrate mixing means connected to receive water and concentrate from the water-chilling and delivery means and the concentrate supply and delivery means and a beverage dispensing tube receiving beverage from the mixing means; the water-chilling and delivery means includes a pressure sealed water tank defining an elongate substantially serpentine water passage with an upstream end connected with a water supply line extending from the water supply system and a downstream end connected with a water delivery line extending from the tank to the mixing means, a check valve in the water supply line and a normally closed water valve in the water delivery line; an electric-powered refrigeration machine with an elongate expansion coil positioned in the tank and extending longitudinally through the water passage; an electric-powered water pump with suction and delivery sides and connected with upstream and downstream end portions of the water passage and continuously recirculating water through the passage and about the expansion coil in the tank; a normally closed temperature-responsive switch in the power supply to the refrigeration machine and set to open when the temperature of water in the tank drops to a set operating temperature.

11. The beverage dispensing machine set forth in claim 10 that further includes a normally closed pressure-actuated switch in the power supply to the refrigeration machine and responsive to the water pressure in the water chilling and delivery means between the check valve and the water valve and set to open when the pressure in the tank exceeds a maximum operating pressure.

12. The beverage dispensing machine set forth in claim 10 that further includes a normally closed pressure-actuated switch in the power supply to the refrigeration machine and responsive to the water pressure in the water chilling and delivery means between the check valve and the water valve and set to open when the pressure in the tank exceeds a maximum operating pressure; the concentrate supply and delivery means includes a bottle of liquid concentrate, a concentrate delivery line extending from the bottle to the mixing means and an electric-powered concentrate pump in the concentrate delivery line; and, a normally open switch means in the power supply to the concentrate pump and operating to close when the water valve is opened.

13. The beverage dispensing machine set forth in claim 10 that further includes a cabinet with a thermally insulated compartment in which the concentrate supply and delivery means are positioned and in which the tank is positioned to chill the concentrate supply means.

14. The beverage dispensing machine set forth in claim 10 that further includes an elongate cooling coil connected with and between the water pump and one end of the passage; a cabinet with a thermally insulated compartment in which the concentrate supply and delivery means are positioned and in which the tank and water pump and cooling coil are positioned to chill the compartment and parts therein.

15. The beverage dispensing machine set forth in claim 14 that further includes an air-recirculating fan in the chamber.

* * * * *